US008836515B2

(12) United States Patent
Albert et al.

(10) Patent No.: US 8,836,515 B2
(45) Date of Patent: Sep. 16, 2014

(54) FLEXIBLE HEAD OF BED ELEVATION DEVICE AND ALARM

(75) Inventors: Richard K. Albert, Denver, CO (US); Robert F. Wolken, Littleton, CO (US); Russell J. Woodruff, Littleton, CO (US); Ivor Samuel Douglas, Englewood, CO (US)

(73) Assignee: Denver Health and Hospital Authority, Denver, CO (US)

( * ) Notice: Subject to any disclaimer, the term of this patent is extended or adjusted under 35 U.S.C. 154(b) by 751 days.

(21) Appl. No.: 12/748,189

(22) Filed: Mar. 26, 2010

(65) Prior Publication Data

US 2010/0245092 A1 Sep. 30, 2010

Related U.S. Application Data

(60) Provisional application No. 61/211,303, filed on Mar. 26, 2009.

(51) Int. Cl.
*G08B 23/00* (2006.01)

(52) U.S. Cl.
USPC ..... 340/573.7; 5/600; 340/573.1; 340/686.1; 340/671

(58) Field of Classification Search
None
See application file for complete search history.

(56) References Cited

U.S. PATENT DOCUMENTS

| | | | | | |
|---|---|---|---|---|---|
| 2,580,302 | A * | 12/1951 | Jones | 200/218 |
| 4,138,893 | A * | 2/1979 | Holmes et al. | 73/514.09 |
| 4,854,047 | A * | 8/1989 | Conanan | 33/377 |
| 5,581,034 | A * | 12/1996 | Dao et al. | 73/514.09 |
| 6,802,132 | B1 * | 10/2004 | Olson | 33/366.15 |
| 7,487,562 | B2 * | 2/2009 | Frondorf et al. | 5/613 |
| 7,657,292 | B2 * | 2/2010 | Baker et al. | 600/310 |
| 8,063,785 | B2 * | 11/2011 | Sacchetti | 340/573.7 |
| 8,357,090 | B2 * | 1/2013 | Baker | 600/306 |
| 2003/0047002 | A1 * | 3/2003 | Arms et al. | 73/504.17 |
| 2003/0106325 | A1 * | 6/2003 | Robbie | 62/50.7 |
| 2006/0253016 | A1 * | 11/2006 | Baker et al. | 600/410 |
| 2007/0118027 | A1 * | 5/2007 | Baker et al. | 600/310 |
| 2008/0146994 | A1 * | 6/2008 | Gerber | 604/66 |
| 2008/0221406 | A1 * | 9/2008 | Baker | 600/306 |
| 2009/0312908 | A1 * | 12/2009 | Van Den Brink | 701/38 |
| 2013/0123588 | A1 * | 5/2013 | Baker, Jr. | 600/306 |

*Primary Examiner* — Benjamin C Lee
*Assistant Examiner* — Rajsheed Black-Childress
(74) *Attorney, Agent, or Firm* — Anton J. Hopen; Smith & Hopen, P.A.

* cited by examiner

(57) ABSTRACT

A device for continuously monitoring an elevation, α, from horizontal of a backrest against which a backbody of an individual may lean, to provide an automatic notification in the event the elevation, α, falls below a prescribed value. The device to include: (a) a liquid column having an opening to atmosphere at an upper-end, the liquid column contained by a length of tubing encased by an elongated flexible housing extending along at least a substantial portion of the tubing length, and a gas permeable membrane over the opening; (b) a pressure transducer located along the liquid column to take measurements at a position other than the upper-end, the pressure transducer in communication with a computerized unit having at least one alarm for communicating the automatic notification; (c) an entry port into the length of tubing having an open state permitting manual entry of the liquid into the tubing, and a closed-shut state; and (d) a first securing mechanism for attachment of at least the upper-end to the backrest, and a second securing mechanism for attaching the position other than the upper-end to, for example, a seat interconnected with the backrest. The first securing mechanism may, alternatively, be used to directly attach the upper-end to the backbody toward the shoulder region thereof. Further, the liquid column may also comprise a second-end extension at which a pressure transducer is located; the pressure transducer may be integrated with the computerized unit and in communication with one or more alarms.

5 Claims, 5 Drawing Sheets

FLEXIBLE HEAD OF BED ELEVATION DEVICE AND ALARM

This application claims priority to pending U.S. provisional patent app. No. 61/211,303 filed 26 Mar. 2009 on behalf of the assignee hereof for the applicants hereof. To the extent consistent with the subject matter set forth herein, provisional app. No. 61/211,303 and its EXHIBITS A-E are hereby fully incorporated, herein, by reference as background technical support.

BACKGROUND OF THE INVENTION

Field of the Invention

In general, the present invention relates to bed elevation devices used for monitoring the backrest elevation from horizontal, or head of bed elevation (HOBE), of hospital beds in which a patient is lying, while ill. As is well known, maintaining sufficiently upright positioning/orientation of a patient's upper torso is extremely important with respect to preventing the development of ventilator-associated pneumonia (VAP), a nosocomial condition that is generally unrelated to the disease for which they are being treated, but rather is caused by aspirating microorganisms colonizing the oropharynx, a problem that is augmented by lying flat or nearly-supine on one's back (e.g., hospital standards recommend, for example, HOBE≥30° as measured from a reference horizontal, to prevent VAP). Conventional devices for measuring backrest elevation of hospital beds fall short as a complete solution to monitoring for compliance with medically recommended HOBE standards. Very often, as applicant-inventors found, compliance using the conventional monitoring techniques and devices is much lower than reported. In fact, achieving full compliance with recommended standard practices has proven difficult to maintain.

General Discussion of Technological Areas (by Way of Reference, Only)

Historical Perspective:

Two conventional mechanisms currently in widespread use in hospitals for monitoring HOBE are shown and labeled FIGS. 1 and 2 at 10A, 10B: Each of these employs a simple visual bead mechanism on the side of the bed to indicate a value for backrest elevation, given in degrees measured from a horizontal reference whereby the bed is laid flat or level. Operation consists of visual periodic monitoring by hospital staff assigned to the patient; and if the HOBE reading is below a set or prescribed value, the backrest is repositioned by the staff member. Very often, for a number of reasons related to bed mechanics, nursing staff repositioning patients for a variety of reasons, irregular patient movement (intentional or not), and so on, HOBE is found to be below that prescribed. As is known within the intensive care units (ICUs) or critical care units of medical facilities (hospitals, urgent care, etc.), insufficient HOBE (elevation angle, α, of a hospital bed backrest from horizontal) can lead to extremely serious complications, or death, for a patient that is lying ill.

Examples of currently available monitoring devices and techniques are shown and labeled in the written materials labeled EXHIBIT A-E in applicants' provisional app. No. 61/211,303, each of which is further identified below and also incorporated by reference herein for its technical background discussion relating to earlier attempts to measure backrest elevation in critical care facilities. One will appreciate the shortcomings of each reference in light of the unique comprehensive solution provided by the instant invention. Unlike currently available systems, the unique backbody elevation measurement and noncompliance notification device of the invention includes an inner column of incompressible fluid, for example clear or distinctively-colored liquid that is preferably, bacteriostatic or bacteriocidal. In a preferred embodiment, the liquid column is contained by tubing (for example, IV tubing) of at least 32 inches in length, with one end open to atmospheric pressure. The tubing is encased by an exterior housing of, for example, sturdy flexible tubing (whether corrugated) extending at least the length of the tubing. The height of the liquid column is measured as a differential pressure relative to atmosphere between the ends of the tube containing the liquid column and the end attached to a pressure transducer/sensor. The height of the liquid is referenced, i.e., calibrated, to measure the angle, α, of the HOBE, and tracked continuously.

If the unique subassembly including the encased inner liquid column with pressure transducers is secured to a backrest (whether of a hospital bed or a reclining chair), the elevation of the backrest is that of the backbody of the patient leaning or lying thereon. When the backbody elevation reading falls below a prescribed value—such as that considered safe for the patient or a vehicle operator—then an alarm activates (either visual, audio, or mechanical|vibration, or a combination thereof) to promptly notify medical staff, or awaken the driver of a vehicle. In the later case, the unique device of the invention, in operation as a portable driver-alert warning device, may save countless tragic accidents on the road, in the air, or on water. Likewise in the case of a patient leaning on a backrest that falls below a prescribed safeharbor value, further complications—whether tragically resulting in death—may be averted by applicants' new HOBE automatic notification device.

Definitions

I. Digital or biological computers. A processor is the set of logic devices/circuitry that responds to and processes instructions to drive a computerized device. The central processing unit (CPU) is considered the computing part of a digital or other type of computerized system. Often referred to simply as a processor, a CPU is made up of the control unit, program sequencer, and an arithmetic logic unit (ALU)—a high-speed circuit that does calculating and comparing. Numbers are transferred from memory into the ALU for calculation, and the results are sent back into memory. Alphanumeric data is sent from memory into the ALU for comparing. The CPUs of a computer may be contained on a single 'chip', often referred to as microprocessors because of their tiny size. As is known, basic elements of a simple computer include a CPU, clock and main memory; whereas a complete computer system requires the addition of control units, input, output and storage devices, as well as an operating system. The tiny devices referred to as 'microprocessors' typically contain the processing components of a CPU as integrated circuitry, along with associated bus interface. A microcontroller typically incorporates one or more microprocessor, memory, and I/O circuits as an integrated circuit (IC). Computer instruction(s) are used to trigger computations carried out by the CPU.

II. Computer Memory and Computer Readable Storage/media. While the word 'memory' has historically referred to that which is stored temporarily, with storage traditionally used to refer to a semi-permanent or permanent holding place for digital data—such as that entered by a user for holding long term—more-recently, the definitions of these terms have blurred. A non-exhaustive listing of well known computer readable storage device technologies are categorized here for reference: (1) magnetic tape technologies; (2) magnetic disk technologies include floppy disk/diskettes, fixed hard disks (often in desktops, laptops, workstations, etc.), (3) solid-state disk (SSD) technology including DRAM and 'flash memory'; and (4) optical disk technology, including magneto-optical disks, PD, CD-ROM, CD-R, CD-RW, DVD-ROM, DVD-R, DVD-RAM, WORM, OROM, holographic, solid state optical disk technology, and so on.

III. Measuring pressure of incompressible fluids. Pressure sensors can vary drastically in the technology employed for measuring height of a column of liquid, overall size, design, performance, application suitability, and cost. Pressure transducers are effectively pressure sensors. A differential pressure sensor measures the difference between two or more pressures introduced as inputs to the sensing unit, for example, measuring the pressure drop across an oil filter. Differential pressure is also used to measure flow or level in pressurized vessels. Another type of pressure transducer contains a diaphragm that gets deformed by a pressure change as measured by a strain gauged element. This technology makes use of the changes in resistance that some materials experience due to change in its stretch or strain (i.e., make use of the change of conductivity of material when experiencing different pressures); the difference is mapped as a function of the change in pressure. A strain gauge is a long length of conductor arranged in a zigzag pattern on a membrane. When it is stretched, its resistance increases.

SUMMARY OF THE INVENTION

Briefly described the invention is directed to a unique device and system for monitoring continuous backbody elevation and automatically providing notification (alarm) when the backbody of a human patient or vehicle operator/driver falls below a threshold elevation value set within the system. In the case of a patient, continuous monitoring of the backbody is preferably accomplished by monitoring an angle of elevation, $\alpha$, (with respect to horizontal/prone spinal position of the patient) of the backrest against which the patient's backbody is leaning. In the case of monitoring the backbody of a vehicle operator sitting in, say, the driver's seat of the vehicle, the device preferably monitors an angle of elevation, $\alpha$, of the backbody, itself, by monitoring elevation, $\alpha$ (as measured with respect to a horizontal/prone orientation, defined as 90° from a ~vertical/upright position of a vehicle operator's spine). The driver's seat backrest is effectively fixed, and it is the backbody's position that is of greatest concern (should not fall below a threshold value for safe vehicle operation).

BRIEF DESCRIPTION OF DRAWINGS

For purposes of illustrating the innovative nature plus the flexibility of design and versatility of the new system and associated technique, the figures are included. One can readily appreciate the advantages as well as novel features that distinguish the instant invention from conventional devices. Where similar components are represented in different figures or views, for purposes of consistency, effort has been made to use categorically-similar reference numbers. The figures have been included, and references made to technical background materials, to communicate the features of applicants' innovation by way of example, only, and are in no way intended to limit the disclosure hereof.

DESCRIPTION DETAILING FEATURES OF THE INVENTION

General background materials authored by others and identified by applicants as EXHIBITS A, B, C, D, and E in connection with—and incorporated by reference into—applicants' provisional app. 61/211,303 for purposes of providing technical background to the extent each is consistent with the discussion provided therein. EXHIBITS A, B, C, D, and E are, once again, respectively identified, as follows:

A) Richard Hummel, et al., "Continuous measurement of backrest elevation in critical care: A research strategy," *Crit Care Med*, vol. 28, No. 7 (2000) pp. 2621-2625;

B) K. Balonov, et al., "A novel method of continuous measurement of head of bed elevation in ventilated patients," *Intensive Care Med*, DOI 10.1007/s00134-007-0616-0 accepted 1 Mar. 2007© Springer-Verlag 2007;

C) C. A. van Nieuwenhoven, M.D., et al., "Feasibility and effects of the semirecumbent position to prevent ventilator-associated pneumonia: A randomized study," *Critical Care Med* vol. 34, No. 2 (2006) pp. 396-402©Lippincott Williams & Wilkins;

D) cover page of U.S. Patent App pub No. US 2007/0044237 A1, filed 24 Aug. 2006 by Williams; and E) cover page of U.S. Patent App pub. No. 2007/0143920 A1, filed 27 Nov. 2006 by Frondorf, et al.

By viewing the figures which depict associated representative structural embodiments, one can further appreciate the unique nature of core as well as additional and alternative features of the new device and associated system for measuring and monitoring backbody elevation. Back-and-forth reference has been made to drawings—especially FIGS. 4-6, 7A-B, 8, and 9—which detail core as well as additional features of the device and system. This back-and-forth reference helps associate respective features within the various FIGURE views that have commonality, providing an overall appreciation of the unique nature of the device and system.

Figure 1:
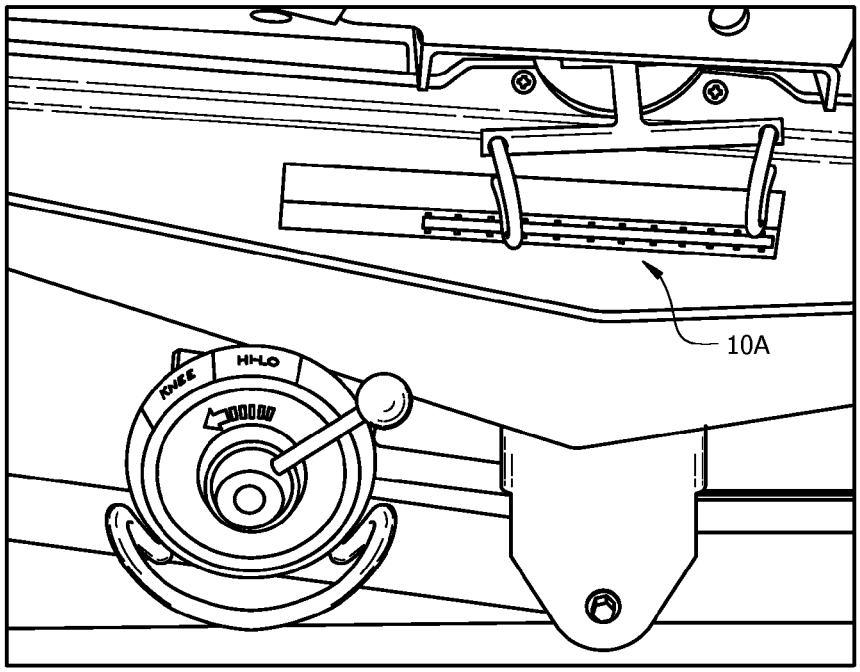
FIG. 1 (Prior Art)
FIG. 1 is an elevated view that illustrates prior art visual bead HOB elevation indication mechanism 10A.
Figure 2:
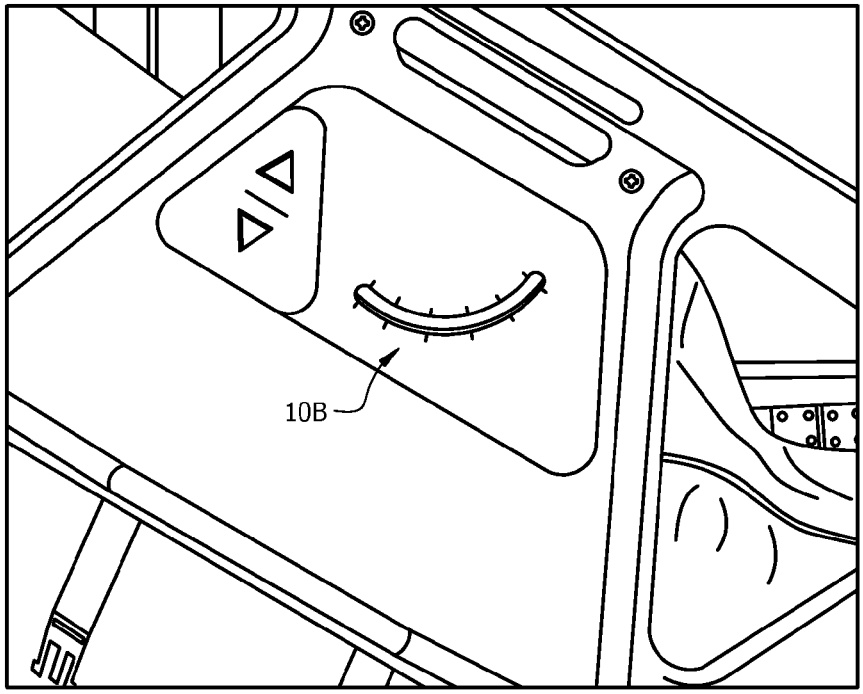
FIG. 2 (Prior Art)
FIG. 2 is an elevated view that illustrates prior art visual bead HOB elevation indication mechanism 10B.

FIGS. 1 and 2 illustrate prior art visual bead HOB elevation indication mechanisms 10A, 10B. A metal bead contained within a travel path located on the side of the hospital bed, is drawn downward by gravity. The travel path is calibrated as noted visually on the side of the bed 10A, 10B to provide a reading for the backrest of the hospital bed. There is no audible or other alarm alerting to change in elevation. As one can imagine, there are many confusing procedures and hospital staff interventions requiring frequent patient position changes, when using a conventional HOB elevation mechanism such as those shown in FIGS. 1 and 2.

Figure 3:
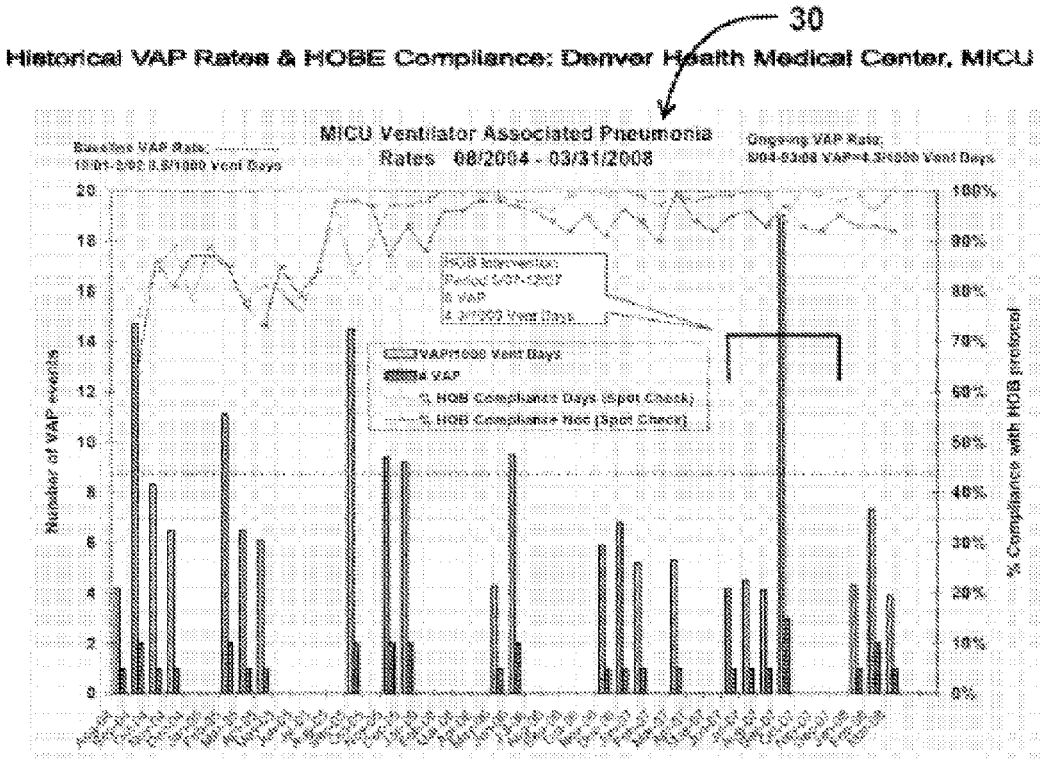
FIG. 3 is a graphical representation compiled using data collected in connection with a study done by applicants during the years noted, 2004-2008, concerning total number of VAP events correlated with values reflecting compliance with the critical care facility's HOB protocol.

FIG. 3 is a graphical representation compiled using data collected in connection with a study done by applicants during the years noted, 2004-2008, concerning total number of VAP events correlated with values reflecting compliance with the critical care facility's HOB protocol.

Figure 4:
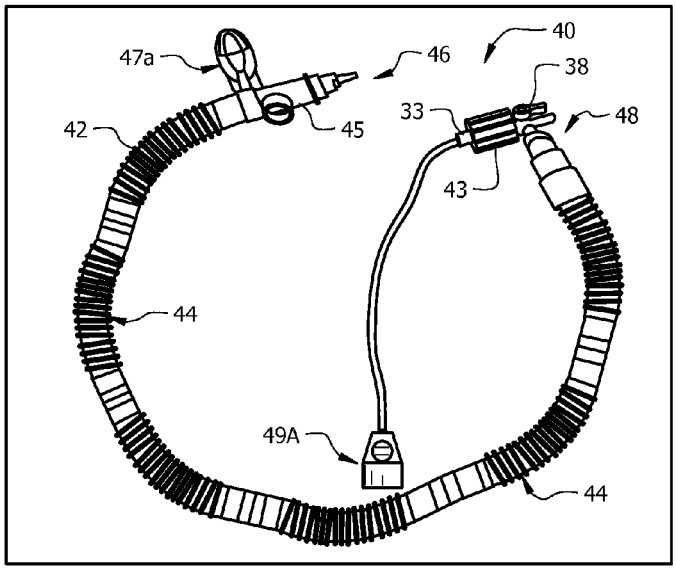
FIG. 4 is an elevated view of a backbody elevation device 40 of the invention, shown—by way of example—in a semicircle configuration, although when in operation and attached to a mechanized hospital bed, is configured in a manner similar to that shown in FIG. 5.
Figure 7A:
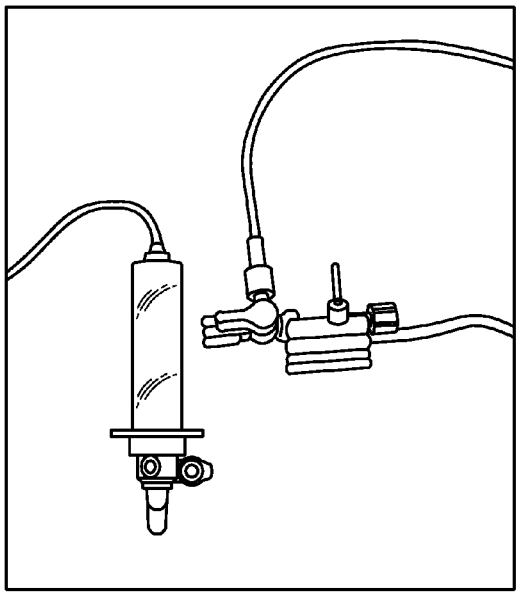
FIG. 7A is an enlarged isometric detailing distal ends 46, 48 of the FIG. 4 device 40.
Figure 7B:
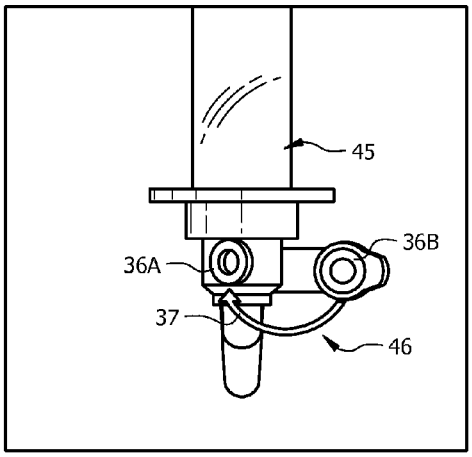
FIG. 7B is a further-enlarged isometric of the distal end 46 depicted in FIG. 7A.

FIG. 4 is a pictorial isometric of a preferred backbody elevation device 40 shown—by way of example—in a semicircle configuration. When in operation and attached to a mechanized hospital bed, device 40 may be secured underneath 52 bed backrest 50 as configured in FIG. 5. FIGS. 7A-B are enlarged pictorial isometrics detailing distal ends 46, 48 of the FIG. 4 device 40. A first distal end 46 is preferably secured, or otherwise suitably clamped 47*a*, toward a top/free-end thereof of the backrest 50. Distal end 48 is equipped with a 3-way stop-cock 38 to facilitate filling|refilling of fluid column 44 with the selected incompressible fluid, such as clear or distinctively-colored liquid—preferably, bacteriostatic or bacteriocidal and generally nontoxic liquids. Inner column 44 is contained within a length of tubing (e.g., FIG. 7A at 44') that is located within a unique exterior casing 42. By way of example, as can be better seen in FIG. 7A, inner column may be made from standard, flexible IV tubing 44' such as that used to deliver fluids to a patient during or after surgery.

Figure 5:
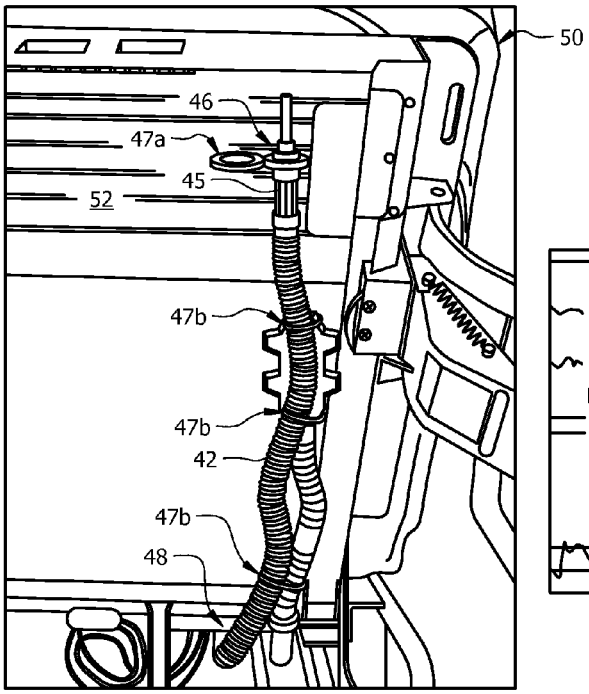
FIG. 5 is an isometric view of the FIG. 4 backbody elevation device 40 in operation as attached—in this embodiment—to the underneath of bed backrest 52.

Uniquely, casing 42 extends at least the length of column 44 and, preferably, also the length of the tubing 44' containing the liquid column 44. Casing 42 is preferably made of a sturdy, lightweight inert plastic having resiliency for ease of handling, yet is resistant to puncture, with a surface that resists microbe growth. One example of such tubing, as shown in FIGS. 4-5 is corrugated, thin-walled, flexible plastic tubing. The perimeter of casing 42 may be of a wide variety of shapes, e.g., circular and corrugated as shown in FIGS. 4 and 5, or alternatively the outer diameter/perimeter of casing 42 can be square, rectangular, triangular in shape, or any other such shape with at least one extended 'flat' or planar surface therealong to facilitate 'flush' attachment to a generally planar undersurface 52 of a backrest 50. Clamping to a backrest 50, FIGS. 5 and 8 (also, FIG. 9 at 200) can be accomplished with, for example, one or more off-the-shelf clamps 47*a* adhered to backrest underside 52 toward a free-end of the backrest, along with one or more off-the-shelf tag ties 47*b* (FIG. 5) along underside 52. Clamping 47*a*, 47*b* is preferably releasable as designed to facilitate convenient removal from backrest 50, 200 permitting handy cleaning and/or replacement of device 40, 140 or a subcomponent thereof.

In the event of use of the new device to monitor the backbody of a vehicle operator sitting in a driver's seat, the device preferably monitors an angle of elevation, α, of the backbody, itself (as measured with respect to a horizontal/prone orientation, defined as 90° from a ~vertical/upright position of a vehicle operator's spine). In this case, referring to high level schematic views in FIGS. 8 and 9 (although not shown—for simplicity—in detail), clamping or attachment 47*a* of casing 42 and inner tubing 44' (FIG. 7A)—permitting measurement of backbody elevation, α—is preferably done directly to the backbody 100. Attachment of distal end 46 may be accomplished by attaching/securing/clipping to an article (say, of clothing) donned on backbody 100, sewing or otherwise attaching into a separate piece (a runner's bib or harness) suitable for donning over the backbody's clothing in a manner so as not to crush outer casing 42 or not to crimp the tubing 44' containing column 44. Preferably, distal end 46 of column 44 is attached/secured to backbody 100 toward the shoulder region (in FIGS. 8 and 9, shoulder region is toward the free/upper left-hand end of backbody 100) permitting monitoring of the angle of elevation, α, of backbody/upper torso, to provide alerts in the event of slouching/operator fatigue.

Figure 6:
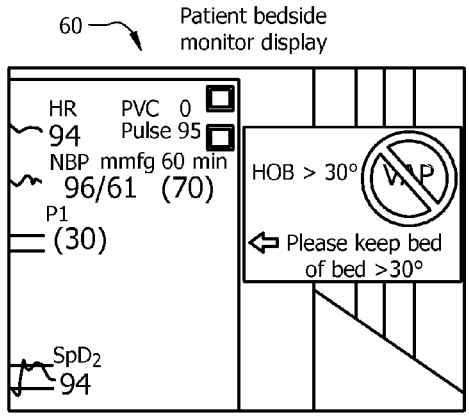
FIG. 6 is a view of a display screen of a traditional computerized monitor, such as that distributed by Hewlett Packard Company, found in ICUs for monitoring a variety of medically significant parameters of a critically ill patient lying in a bed.

FIG. 6 is a pictorial of a display screen 60 of a traditional computerized monitor, such as that distributed by Hewlett Packard Company, found in critical care units or intensive care units (ICUs) for monitoring a variety of medically significant parameters of a critically ill patient lying in a bed. A conventional monitor may be employed according to the invention to accommodate the use of the unique device 40, 140 in operation to continuously monitor HOBE of a backrest (such as that shown at 50 or 200) and provide automatic notification of noncompliance of a pre-determined HOBE standard, such as that shown via visual notation in FIG. 6: "HOB >30°" and "Please keep Head of Bed >30°" by way of example. TABLE 1 is a table representing data collected during a research study done by applicants of backrest elevation of a hospital bed connected to a traditional computerized monitor having display screen 60 such as shown in FIG. 6 employing spot checks of HOBE.

TABLE 1

| Study Period May 15, 2007-Dec. 31, 2007 | | |
|---|---|---|
| MV episodes | 31 % of all vent pt episodes were monitored 98/313* | |
| MV Days/hours | 23.45% of MV days were monitored (322 of 1373 MV days) or 7720 monitored hours (V = 5542 h; NV = 2178 h). | |
| HOB angle | ≥28° | |
| Visible (hours ≥ 28°) | 75.5% (4183/5542) | $\chi^{2P} < 0.0001$; (RR 1.25) |
| Non-visible (hours ≥ 28°) | 60.65% (1321/2178) | |
| Spot checks for HOB angle > 30° | 96 +/− 2% | |

Figure 8:
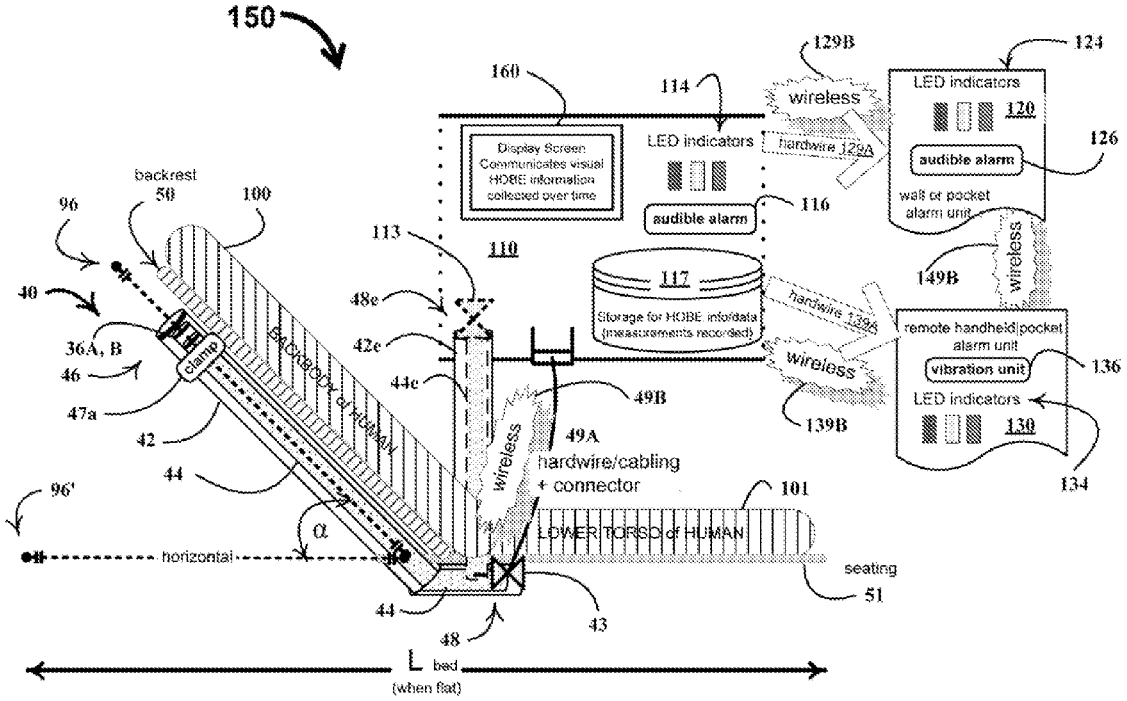
FIG. 8 is a high-level schematic depicting features of system 150 incorporating, by way of example for purposes of illustrating this embodiment, device 40 adapted to automatically monitor the elevation angle $\alpha$ of backbody 100.
Figure 9:
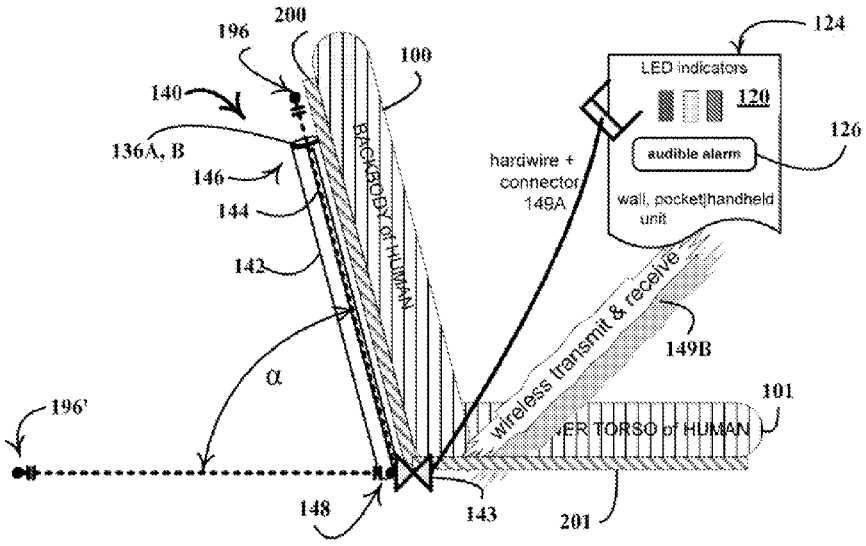
FIG. 9 is a high-level schematic depicting features of system 250 incorporating, by way of example for purposes of illustrating this embodiment, device 140 adapted to automatically monitor the elevation angle $\alpha$ of a backrest 200 against which backbody 100 is leaning.

FIG. 8 and FIG. 9 are high-level schematics representing features of system embodiment combinations 150, 250 that incorporate, by way of example only, devices 40, 140 adapted to automatically monitor the elevation angle α of backbody 100 resting or leaning-back against a backrest, 50, 200. In connection with describing, next, the second end 48, 148 of the column/casing, several figures are considered collectively, namely, FIGS. 4, 5, 7A, 7B, 8, and 9. Second-end 48, 148, is generally positioned, in operation, at or near a pivot area at the lower end of a backrest 50, 200, as shown. Distal second-end 48, 148 may be secured to an underside of the bed seating 51, 201 (as as is suggested in FIGS. 5, 8), or other suitably convenient location such that the pressure transducer 43, 143 remains generally stationary during monitoring of the HOBE/elevation angle, α, from horizontal.

Second-end subassembly 48, 148 preferably has the following characteristics|features: a conventional 3-way stopcock assembly 38 is connected to a pressure transducer 43, 143 in fluid communication with the bottom interface of the column of liquid 44, 144. A reducing coupler and rubber gasket (not labeled) provide a sealed connection between an outer casing 42, 142 and a stopcock assembly 38. Stopcock 38 is designed to facilitate—when in an 'open' condition/state—acceptance of the nose of a conventional liquid syringe (not shown, for simplicity). In this manner, a syringe containing the liquid is used to fill the length of the tubing (FIG. 7A, 44') to create a desired liquid column 44. The syringe is also useful for removing bubbles that may have developed along column 44, or to refill tubing (FIG. 7A, 44') with liquid in the event enough has evaporated to the point of affecting automatic-readings of the HOBE angle, α. Once filling to reach column 44, 144 is complete, stopcock 38 is closed-shut to prevent leakage of the liquid column. Uniquely, a distinctly-colored liquid used can be identified upon accidental leakage somewhere along column 44, 144 or distal second-end 48, 148. If the casing/tubing (FIG. 7A, 44') holding column 44, 144 and casing 42, 142 are made of a generally transparent material, monitoring of a respective column for purposes of maintaining a specified height, can be achieved by visual inspection of device 40, 140.

As detailed in enlarged fashion in FIGS. 7A-7B, the liquid column contained by tubing 44' is open to the atmosphere (side-vent 36A is shown covered by a gas permeable membrane, by way of example) at distal 'upper' end 46; see, also, FIGS. 4-5. Venting of column 144 of FIG. 9 is done at distal end 146 as represented at 136A, 136B. The smallish-sized side-vent/opening 36A is integrated with distal end 46 to provide a means for regulating the differential pressure reading(s) of the column fluid with respect to the atmosphere. Opening 36A may be equipped with a cap 36B to close-off (it may be snapped-shut along directional arrow 37) and seal liquid column 44 to prevent evaporation of the liquid within column 44 into atmosphere through the gas permeable membrane covering opening 36A.

The pressure transducer/sensor element is preferably either integral with the second-end subassembly 48, 148 (FIGS. 8, 9) or the pressure transducer/sensor element may be integrated (such as at 113, dashed lines) with a monitor 110, or elsewhere in fluid communication with column 44, 144. In the event the pressure transducer 113 is integrated within the housing of monitor 110, the transducer 113 is placed in fluid communication with to the main liquid column 44 by way of a liquid column extension (such as is depicted in FIG. 8 at 44*e*, dashed lines). In the case of using a column extension such as that labeled 44*e*, column outer casing 42 is preferably likewise extended 42*e* (dashed lines). Thus, as depicted in FIG. 9, alternative pressure transducer 113 is suitably incorporated/integrated with unit 110 and located at an extension second-end, labeled 48*e* for reference, in operation with device assembly 40. One or more alarms 114 (LED type) and/or 116 (audible type) is electrically interconnected to receive electrical signals of pressure measurements made by/at transducer 113, in this embodiment, via the internal electrical circuitry (not shown, for simplicity) of the computerized monitor unit 110.

Referring to FIGS. 8 and 9: Pressure measurements made by a transducer/sensor 43, 143, 113 may be sent to monitor 110 or wall |handheld| pocket unit 120 via hardwire 49A, 149A or via wireless communication device/transmit-receive assembly 49B, 149B (such as via infra red, radio frequency/"RF", or other open electromagnetic/"EM" frequency) transmitting from the second-end 48, 148. A cap 33 for the pressure transducer 43 has been labeled in the embodiment depicted in FIGS. 4 and 7A.

One can appreciate the flexibility of the unique system design (see, FIGS. 8 and 9), in communication with subunits as represented: For example, a shelf-sized monitor 110 having a footprint requires shelving space. A main monitor 110 may be further in communication—or coupled with—via hardwire connection 129A, 139A, 149A or wireless transmission 129B, 139B, 149B, one or more smaller-sized units, 120, 130 which may be transported in a jacket pocket of a healthcare provider (alternatively, an operator of a vehicle) for ready-alert, and/or the smaller-sized units 120, 130 may be retrofitted for temporarily attachment to a wall of a nurses' station, hospital reception desk, laboratory, vehicle dashboard, or other such area staffed by an individual who can be alerted by any alarm(s).

Due to footprint/space requirements, main monitor units (such as 110) are generally positioned near a patient's bed (and in the case of a vehicle, such a unit may be prohibitively large). Uniquely incorporating one or more smaller-sized unit 120, 130 provides ready-communication for timely feedback to hospital staff—or in the case of vehicle use, to warn a driver as s/he begins slumping due to fatigue—in the event a HOBE reading falls below a prescribed safe level. Providing such timely feedback to an individual (healthcare provider) in proximity to take action, can be life-saving. Healthcare facility personnel are often busy making rounds to check-up and address many patients' needs during any given work-shift; being within range to hear, see, feel an HOBE alarm can be critical to patient health. Likewise, where the device 40, 140 is used within the confines of a vehicle for continuous automatic-monitoring of the elevation/angle of the backbody of the driver/vehicle operator, such a 'remote' wall or handheld unit 120, 130 is preferably employed/located so as to alert a groggy driver to awaken and take control, before its-too-late!

For example, within a healthcare facility, unit 120, 130 may be placed on a desktop or hung on a wall to notice visual alarms (114, 124, 134), placed inside a lab hospital coat pocket to feel vibration from a vibration alarm 136, and/or to hear an audible alarm 126. In the case of use within a vehicle, a unit 120, 130 may be affixed or secured to the dashboard (out of the way and within earshot to hear audible alarms 126) or placed inside a coat pocket of the driver, so s/he can feel vibration from a vibration alarm 136 and/or better hear an audible alarm 116. As one can appreciate, the device 40, 140 is adaptable for vehicles of all sorts: motorized vehicles (cars, trucks, buses, jeeps, tractors and other farm equipment), aircraft/jets, watercraft (ships, motor boats, sail boats, and so on), trains, and so on.

Inner column 44 along with any extension 44*e* (or, FIG. 9 at 144) is preferably of a total length determined by taking into account the accuracy of the pressure transducer 43, 143, 113. A suitable pressure transducer (43, 143, 113) can be selected from the hundreds of off-the-shelf/existing pressure transducer designs adapted to provide measurements reflecting pressure differentials within a an incompressible fluid system. As depicted in FIGS. 4-5, 7A-7B by way of example only, a total column length of at least ~32 inches of bacteriostatic water was used, being contained by an off-the-shelf medical grade plastic IV tubing 44'. An off-the-shelf electromechanical pressure transducer 43 and an off-the-shelf 3-way valve 38 were assembled in communication with IV tubing 44' containing the column of fluid. This assembly 40 (e.g., as depicted by FIGS. 4-5, 7A-7B) was calibrated with a monitor after being interconnected 49A so as to continuously monitor HOBE of 30°±~3° of backrest 50 (FIG. 5) from horizontal by measuring pressure differentials associated with pressure change(s) due to change(s) in HOB elevation angle, α, from horizontal. Shorter liquid column lengths are contemplated and useful when transducers 43, 143 are chosen to measure pressure differential(s) with greater accuracy. As represented in FIG. 8, HOBE device 40 (for further detail of this particular embodiment, see FIGS. 4 and 5) inner column 44 is shown having an axis 96 at elevation angle, α, from horizontal, which moves to position 96' when the backbody 100 is prone/flat in line with lower torso 101.

The new device 40 is uniquely designed into a system 150 to provide flexibility of use as a retrofit solution adapted for use with conventional critical care monitoring equipment (whether a pressure transducer element already integrated therewith is employed), or for use with a new stand-alone monitor 110 (plugged-in or independently 'battery' powered, small or large-sized footprint) having alarm notification capability (LEDs 114 and/or an audible alarm 116) and uniquely programmed to display 60, 160 information collected from HOBE (angle, a) readings taken throughout a selected time-frame. Storage of HOBE information/data is stored 117 for later retrieval and play-back (160) by a health care professional, as needed. Further capabilities of the monitor 110 include wireless|EM 129B, 139B 'remote' transmission (or hardwire 129A, 139A) to a wall or pocket alarm unit 120 and/or wireless|EM 139B 'remote' transmission (or hardwire 139A) to handheld pocket unit 130 equipped with audible alarms (126), vibration alert (136), and/or LED (124, 134) visual notification, for the purpose of automatically alerting critical care staff when an HOBE reading falls below a preset threshold value, indicating action is promptly required. A respective monitoring unit 110, 120, 130 is programmed to automatically send a signal to alert staff, or vehicle driver, that backrest 50 (or FIG. 9 at 200), and thus the backbody 100, requires action to be returned to a preset threshold angle, α. In the event an off-the-shelf monitor 110, or the smaller unit 120 in FIG. 9, is not initially equipped with a port sized and shaped to accept the connector located at the end of hardwire/cabling 49A, 149A, an adapter connector may be employed.

FIG. 9 further highlights the flexibility of the instant device 140 in an alternative system 250 wherein the device 140 is in communication (wireless|EM transmit and receive 149B, or hardwire interconnection 149A) with a wall or pocket unit 120 programmed to alert staff—alternatively, the driver 100, 101 of a vehicle—of a re-positioning of a backbody 100 that has reached an unsafe elevation (angle, α) below a selected threshold. By way of reference only, inner column 144 of liquid is shown with its axis 196 at elevation angle, α, from horizontal, which will reach a position labeled 196' when the backrest 200 (and, thus, backbody 100) is prone/flat and in line with horizontal seat 201 (note, lower torso 101 is sitting atop seat 201).

While certain representative embodiments and details have been shown for the purpose of illustrating features of the invention, those skilled in the art will readily appreciate that various modifications, whether specifically or expressly identified herein, may be made to these representative embodiments without departing from the novel core teachings or scope of this technical disclosure. Accordingly, all such modifications are intended to be included within the scope of the claims. Although the commonly employed preamble phrase "comprising the steps of" may be used herein, or hereafter, in a method claim, the applicants do not intend to invoke 35 U.S.C. §112 ¶6 in a manner that unduly limits rights to their innovation. Furthermore, in any claim that is filed herewith or hereafter, any means-plus-function clauses used, or later found to be present, are intended to cover at least all structure(s) described herein as performing the recited function and not only structural equivalents but also equivalent structures.

We claim:

1. A device for continuously monitoring an angular elevation, α, from horizontal of a bed backrest against which a backbody of an individual may lean, to provide an automatic notification in the event the angular elevation, α, falls below a prescribed value, the device comprising:

(a) a liquid column of substantially incompressible fluid open to the atmosphere at an upper-end, said liquid column contained by a length of flexible inner tubing encased by an elongated flexible outer housing extending along at least a substantial portion of said inner tubing length, and a gas permeable membrane over said opening;

(b) a pressure transducer located along said liquid column to take measurements of pressure of the liquid column dependent on the angle of elevation at a position other than said upper-end, said pressure transducer in communication with a computerized unit having at least one alarm for communicating the automatic notification;

(c) an entry port into said length of said flexible tubing having an open state permitting manual entry of said liquid into said flexible tubing, and a closed-shut state; and (d) a first securing mechanism for attachment of at least the upper-end to the bed backrest, and a second securing mechanism for attaching said position other than said upper-end to a seat interconnected with the backrest whereby the bed backrest may be retrofitted with said device, the flexible inner tubing and flexible outer housing conforming to attachments points on said bed backrest afforded by the flexibility of both the inner tubing and outer housing.

2. The device of claim 1, wherein:

(a) said liquid column is at least 32 inches in length;

(b) said gas permeable membrane over said opening is equipped with a flip-cap for releasable closure over said membrane; and (c) said flexible housing comprises corrugated plastic tubing having an inner diameter greater than an outer diameter of said length of tubing containing said liquid column and at least one extended planar surface thereby facilitating flush attachment to a generally planar undersurface of said backrest.

3. A device for continuously monitoring an angular elevation, α, from horizontal of a backbody of an individual operating a vehicle and leaning against a backrest, to provide an automatic notification in the event the angular elevation, α, falls below a prescribed value, the device comprising:

(a) a liquid column of substantially incompressible fluid open to the atmosphere at an upper-end, said liquid column pre- calibrated for monitoring the elevation, α, and contained by a length of flexible inner tubing encased by an elongated flexible outer housing extending along at least a substantial portion of said inner tubing length, and a gas permeable membrane over said opening;

(b) a pressure transducer located along said liquid column to take measurements of pressure of the liquid column dependent on the angle of elevation at a position other than said upper-end, said pressure transducer in communication with a computerized unit having at least one alarm for communicating the automatic notification;

(c) an entry port into said tubing having an open state permitting entry of said liquid into said tubing, and a closed-shut state; and (d) a first securing mechanism for releasable attachment of at least the upper-end to the backbody toward the shoulder region thereof of the individual leaning against the backrest and operating the vehicle whereby slouching associated with operator fatigue is monitored by the pressure transducer and provided the angular elevation αfalls below the prescribed angle, the at least one alarm is actuated thereby alerting the individual to awaken and resume control of said vehicle and wherein the flexible inner tubing and outer housing conform to the attachment afforded by their flexibility.

4. The device of claim 3 in use in a vehicle:

(a) wherein said first securing mechanism for releasable attachment comprises attaching to an article donned on the backbody of the individual; and (b) further comprising a second securing mechanism for releasably attaching said position other than said upper-end to a seat interconnected with the backrest.

5. A device for continuously monitoring an angular elevation, α, from horizontal of a bed backrest against which a backbody of an individual may lean, to provide an automatic notification in the event the angular elevation, α, falls below a prescribed value, the device comprising:

(a) a liquid column of substantially incompressible fluid open to the to atmosphere at an upper-end, said liquid column contained by a length of flexible inner tubing encased by an elongated flexible outer housing extending along at least a substantial portion of said inner tubing length, and a gas permeable membrane over said opening;

(b) said liquid column comprising a second-end extension at which a pressure transducer is located to measure pressure exerted by the liquid column dependent on the angle of elevation, said pressure transducer integrated with a computerized unit and in communication with at least one alarm for communicating the automatic notification;

(c) an entry port into said length of tubing having an open state permitting entry of said liquid into said tubing, and a closed-shut state; and (d) a first securing mechanism for attachment of at least the upper-end to the bed backrest whereby the bed backrest may be retrofitted with said device, the flexible inner tubing and flexible outer housing conforming to attachments points on said bed backrest afforded by the flexibility of both the inner tubing and outer housing.

* * * * *